US011834258B2

(12) United States Patent
Nowicky

(10) Patent No.: US 11,834,258 B2
(45) Date of Patent: Dec. 5, 2023

(54) INTERMEDIATE BULK CONTAINER SYSTEMS AND METHODS OF USING SAME

(71) Applicant: A.R. Arena Products, Inc., Rochester, NY (US)

(72) Inventor: David A Nowicky, Fairport, NY (US)

(73) Assignee: A. R. Arena Products, Inc., Rochester, NY (US)

( * ) Notice: Subject to any disclaimer, the term of this patent is extended or adjusted under 35 U.S.C. 154(b) by 0 days.

(21) Appl. No.: 17/466,243

(22) Filed: Sep. 3, 2021

(65) Prior Publication Data

US 2023/0076758 A1 Mar. 9, 2023

(51) Int. Cl.
*B65D 88/52* (2006.01)
*B65D 88/54* (2006.01)
(Continued)

(52) U.S. Cl.
CPC ..... *B65D 88/522* (2013.01); *B65D 19/18* (2013.01); *B65D 77/06* (2013.01); *B65D 77/061* (2013.01);
(Continued)

(58) Field of Classification Search
CPC ..... B65D 88/522; B65D 77/06; B65D 88/54; B65D 2588/125; B65D 25/005; B65D 2519/00034; B65D 2519/00069; B65D 2519/00174; B65D 2519/00208; B65D 2519/00338; B65D 2519/00422; B65D 2519/00611; B65D 2519/00646;
(Continued)

(56) References Cited

U.S. PATENT DOCUMENTS 4,192,430 A * 3/1980 Cornou ..... B65D 19/18 220/817
4,674,647 A * 6/1987 Gyenge ..... B65D 19/18 220/6
(Continued)

FOREIGN PATENT DOCUMENTS

WO 97/31832 A1 9/1997

OTHER PUBLICATIONS

VFC 5829H6 Bulk Cart, Product Specification, https://web.archive.org/web/20160303124732/https:// mytonindustries.com/index.php/bulk-carts/vfc-5829h6 (Wayback date of Mar. 3, 2016).
(Continued)

*Primary Examiner* — Frederick C Nicolas
(74) *Attorney, Agent, or Firm* — Simpson & Simpson, PLLC

(57) ABSTRACT

An intermediate bulk container (IBC) system including a base and walls, and having an interior space. The system comprises a drain in the base or in a wall, a liner bag having a liner bag drain couplable to the drain in the base or in a wall, and a door coupled to the wall by a hinge and shaped to cover an opening in the wall. The opening extends from a top of the wall. The hinge is coupled to the door to allow the door to rotate into the interior space. A stop prevents the door from rotating beyond the wall. The system may be used by rotating the door into the interior space to expose the opening, reaching through the opening and operatively coupling the liner bag drain at the drain in the base or in a wall, and rotating the door to cover the opening.

20 Claims, 10 Drawing Sheets

(51) Int. Cl.
*B65D 77/06* (2006.01)
*B65D 19/18* (2006.01)
*B65D 25/00* (2006.01)

(52) U.S. Cl.
CPC ..... *B65D 88/54* (2013.01); *B65D 25/005* (2013.01); *B65D 2519/009* (2013.01); *B65D 2519/00034* (2013.01); *B65D 2519/00069* (2013.01); *B65D 2519/00174* (2013.01); *B65D 2519/00208* (2013.01); *B65D 2519/00338* (2013.01); *B65D 2519/00422* (2013.01); *B65D 2519/00611* (2013.01); *B65D 2519/00646* (2013.01); *B65D 2519/00711* (2013.01); *B65D 2519/00805* (2013.01); *B65D 2588/125* (2013.01)

(58) Field of Classification Search
CPC ..... B65D 2519/00711; B65D 2519/00805; B65D 2519/009; B65D 19/18; B65D 77/061
See application file for complete search history.

(56) References Cited

U.S. PATENT DOCUMENTS 4,793,519 A * 12/1988 Voorhies, Jr. ..... B65D 77/0466 220/661
4,923,079 A * 5/1990 Foy ..... B65D 19/18 220/326
5,094,356 A 3/1992 Miller
5,199,592 A * 4/1993 Reiland ..... B65D 11/1833 220/817
5,586,675 A * 12/1996 Borsboom ..... B65D 11/1833 220/6
5,845,799 A * 12/1998 Deaton ..... B65D 19/18 220/23.9
5,938,059 A * 8/1999 Luburic ..... B65D 11/1833 220/6
6,120,181 A 9/2000 Wilcox
6,234,351 B1 5/2001 Wilcox
6,427,873 B2 8/2002 Wilcox
6,467,652 B2 10/2002 Wilcox et al.
7,281,637 B2 * 10/2007 Hadar ..... B65D 19/18 220/4.28
7,357,271 B2 4/2008 Hase et al.
7,484,634 B2 * 2/2009 Apps ..... B65D 19/18 220/6
8,757,412 B2 * 6/2014 Sommer ..... B65D 11/1833 220/4.28
9,731,864 B2 * 8/2017 Turner ..... B65D 25/005
10,118,727 B2 * 11/2018 Wilcox ..... B65D 11/1833
10,167,660 B2 1/2019 Ficker
10,273,052 B2 * 4/2019 Wilcox ..... B65D 25/005
10,583,963 B2 3/2020 Su et al.
10,676,239 B2 * 6/2020 Allegretti ..... B65D 19/06
10,773,871 B2 * 9/2020 Schütz ..... B01F 27/25
10,822,162 B2 11/2020 McGonnell et al.
2004/0200833 A1 * 10/2004 Dubois ..... B65D 19/18 220/6
2006/0032854 A1 * 2/2006 Schutz ..... B65D 1/46 220/562
2006/0260976 A1 * 11/2006 Apps ..... B65D 19/18 206/600
2008/0169285 A1 * 7/2008 Marazita ..... B65D 19/18 220/6
2010/0055380 A1 * 3/2010 Schutz ..... G09F 23/00 428/81
2018/0016077 A1 * 1/2018 Blömer ..... B65D 25/16

OTHER PUBLICATIONS

Horen plastics, "HOREN Releases Revolutionary New Folding Liquid IBC, OptiFlow330," LinkedIn article (published Mar. 9, 2016).
Arena.com, "330 Gallon IBC Liquid Shipper," Product Specification, http://arenaproducts.com/intermediate-bulk-container/330-gallon-liquid-shipper/ (printed Aug. 2, 2021).
Arena.com, "Intermediate Bulk Container Advantages," http://arenaproducts.com/intermediate-bulk-container/applications/ (printed Aug. 2, 2021).
Arena.com, "Accessories," http://arenaproducts.com/ibc-liquid-liners/ibc-accessories/(printed Aug. 2, 2021).
https://www.horengroup.com/TonCube.html; Product existed prior to Sep. 3, 2021; Brochure Accessed Mar. 20, 2023.

* cited by examiner

INTERMEDIATE BULK CONTAINER SYSTEMS AND METHODS OF USING SAME

FIELD

Intermediate bulk container (IBC) systems and methods, and in particular IBC systems including an access door and methods of using same.

BACKGROUND

Shipping containers are available in a large variety of sizes ranging from small (i.e., hand-carriable) to large (e.g., intermodal shipping containers). Intermediate bulk containers (IBCs) are understood to be shipping containers of medium size, typically having a carrying capacity in the range of about 1,000 and 1,500 liters and transportable on a pallet using a forklift.

IBCs have been designed for transporting goods having an assortment of characteristics. For example, goods vary from relatively large and easily grasped, to amorphous (e.g., liquids or pastes).

In some instances, it is advantageous to provide access to goods within an IBC such that direct contact can be made goods within the container; however, dimensions of IBCs are typically such that reaching over the top of the container into the interior (also referred to herein as the interior space) of the container is not convenient or possible. For such instances, access doors (also referred to herein simply as doors) have been added to IBC designs. For example, U.S. Pat. No. 10,583,963 describes a door providing access to goods within a container.

In other instances, direct contact with the goods is not desirable or even practicable, for example when the goods are flowable material, such as liquids, pastes or flowable solids (e.g., grains). In such instances, intermediate bulk containers are commonly used in conjunction with a liner bag to form a container system capable of transporting and dispensing goods.

In addition to providing requisite containment of various types of goods, IBCs of differing wall constructions have been designed to address various logistical demands associated with shipping and manufacturing cost constraints. While some applications allow for IBC constructions providing robustness of construction (e.g., multiply walls), other applications demand a lightweight construction including a single-ply wall construction.

Given the different wall constructions, door designs to provide access to the interior of a container of a given wall construction may be unsuitable for use in some applications.

SUMMARY

Given the height of IBCs, installation of a liner bag into an IBC prior to filling of the bag with a flowable material has proven challenging and often requires the use of a specialized tool or improvisation to properly install and align the liner bag within the container. The inventor has determined that an improved door design for use in an IBC system is needed to facilitate installation and alignment of a liner bags in an IBC, in particular within IBCs of single-ply wall construction.

An aspect of the invention is directed to an intermediate bulk container system for shipping of goods. The system comprises a base and four walls extending from the base. The four walls together with the base define an interior space. A first drain is formed in the base or in a first of the walls proximate the base. The system also includes a liner bag having a second drain operatively couplable to the first drain, and a door coupled to one of the walls by a door hinge. The door is shaped to cover an opening in the one of the walls. The opening extends from a top of the one of the walls. The door hinge is coupled to the door at the bottom of the opening and configured to allow the door to rotate into the interior space. The door and the one of the walls is sized and shaped to prevent the door from rotating beyond the one of the walls.

In some embodiments, the lateral sides of the opening are sloped such that the opening is larger at the top of the opening than at the bottom of the opening.

In some embodiments, the walls of the container are of single-ply construction.

The walls may be coupled to the base by one or more wall hinges.

In some embodiments, the base comprises four partial walls to which the walls are coupled. In some embodiments, the first drain is located within a lower quarter of the vertical extent of the container as measured from a bottom surface of the interior space.

In some embodiments, at least one of the first drain and second drain comprises a valve to selectively control flow of the goods therethrough.

The first drain and the second drain may be coupled together. In some embodiments, the first drain and the second drain are connected together using at least one of a rotatable connection or a snap connection.

In some embodiments, the container comprises stops formed on lateral sides of the door to prevent the door from rotating beyond the one of the walls. For example, the stop comprises two portions extending along lateral sides of the opening. In some embodiments, the two portions are integrally formed with the one of the walls.

In some embodiments, the first of the walls and the one of the walls are a same wall.

Another aspect of the invention is directed to a method of using an intermediate bulk container comprising a base and four walls extending from the base, in which the four walls together with the base define an interior space, a first drain is formed in the base or in one of the walls proximate the base, a door is coupled to one of the walls by a hinge, the door is shaped to cover an opening in the one of the walls, the opening extends from a top of the one of the walls, the hinge is coupled to the door at the bottom of the opening, and hinge is configured to allow the door to rotate into the interior space, and the door and the one of the walls are sized and shaped to prevent the door from rotating beyond the one of the walls. The method comprises (i) rotating the door into the interior space to expose the opening, (ii) reaching through the opening to introduce a liner bag having a second drain into the interior space and to operatively couple the second drain at the first drain, and (3) rotating the door to cover the opening.

In some instances, the step of rotating the door to cover the opening comprises rotating the door until contact occurs between a stop formed on the door and the one of the walls, or between the door and a stop extending along sides of the opening.

In some instances, the walls of the container are of single-ply construction.

The first drain may be located within a lower quarter of the vertical extent of the container as measured from a bottom surface of the interior space.

In some instances, operatively coupling comprises connecting the first drain and the second drain together using at least one of a rotatable connection or a snap connection.

These and other aspects of the present invention will become apparent upon a review of the following detailed description and the claims appended thereto.

DETAILED DESCRIPTION

The invention will be further discussed with reference to the following specific examples. It is understood that these examples are given by way of illustration and are not meant to limit the claimed inventions beyond the text of the claims.

Figure 1:
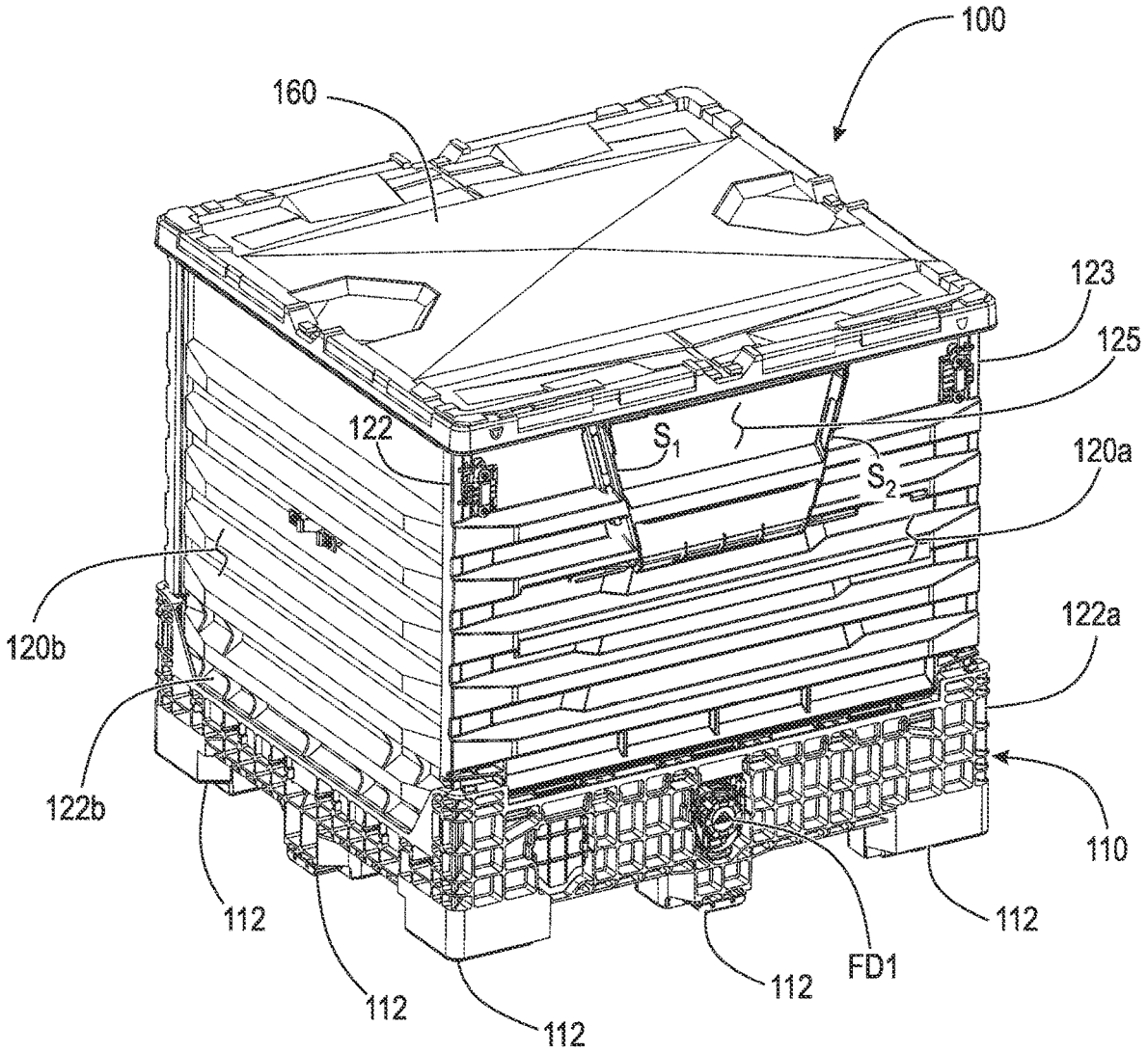
FIG. 1 is a perspective view of an example of a container according to aspects of the present invention including an access door.
Figure 2:
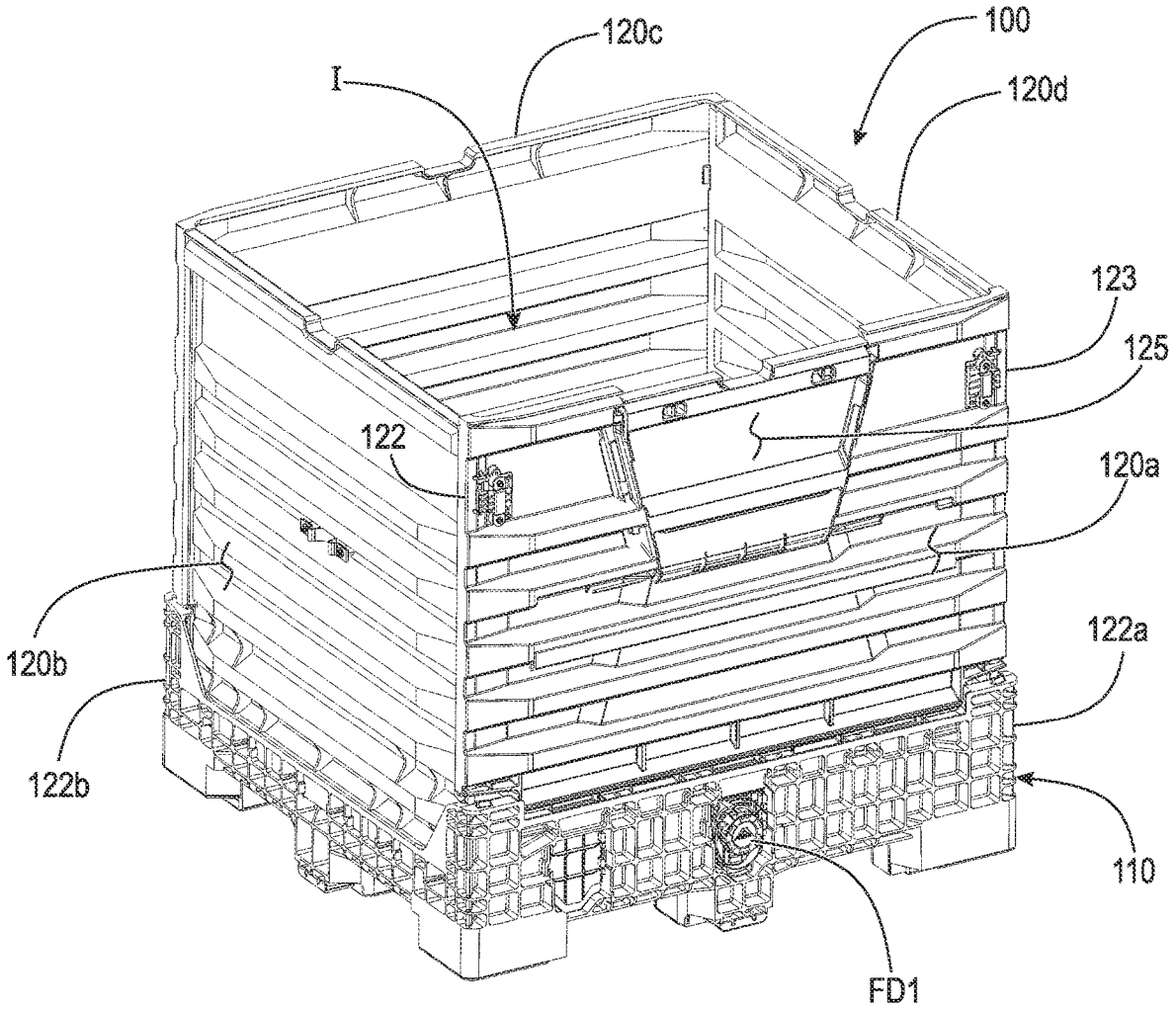
FIG. 2 is a perspective view of the container of FIG. 1, with the cover removed.
Figure 3:
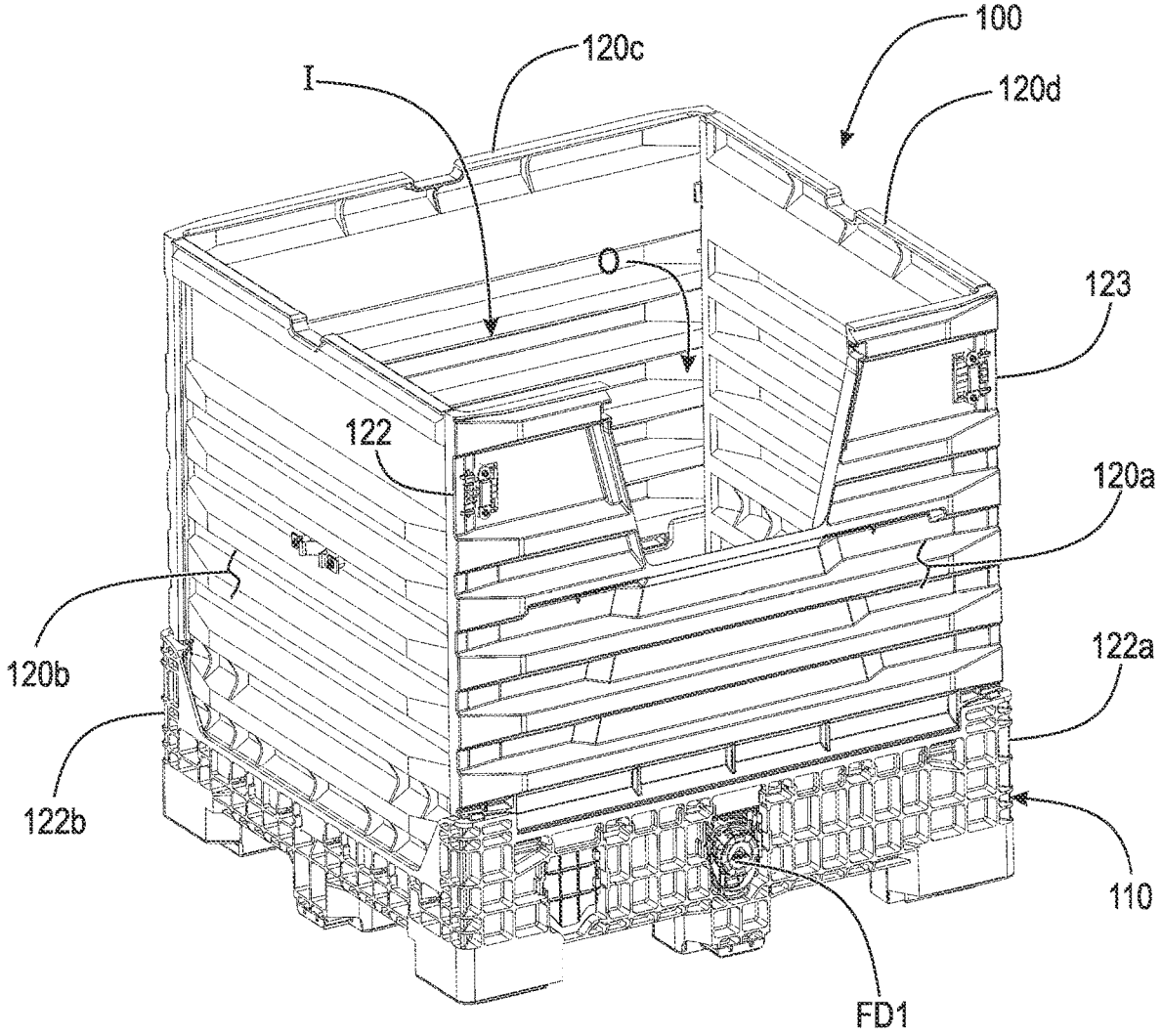
FIG. 3 is a perspective view of the container of FIG. 1 with the cover removed and the access door in an open position.

FIGS. 1-3 are perspective views of an example of an intermediate bulk container system comprising a container 100 and a liner bag 400 (shown in FIG. 4C) according to aspects of the present invention. Container 100 includes an access door 125 to facilitate installation and alignment of liner bag 400 within container 100.

Container 100 comprises a base 110 and four walls 120*a*-120*d* extending from the base. Four walls 120*a*-120*d* together with base 110 define an interior space I. Base 110 supports walls 120*a*-120*d*. In the illustrated embodiment, walls 120*a*-120*d* are coupled to the base via hinges (shown in FIG. 6 as representative hinges 610) in a conventional manner; however, in other embodiments, the walls may be rigidly attached to the base or integrally formed with the base.

In the illustrated embodiment, the base includes partial walls 122*a*-122*d* (i.e., a vertical portion extending up from bottom surface B (shown in FIG. 4A) of the interior space I) to which walls 120*a*-120*d* are attached; however, the partial walls may not be present in some embodiments such that the base substantially extends only in a horizontal direction. In the illustrated embodiment, the base is supported off the ground by feet 112.

In the illustrated embodiment, the four walls couple together to maintain the walls upright. The coupling mechanism may include any suitable mechanism for providing suitable integrity of the resulting structure. In the illustrated embodiment, the coupling mechanisms are illustrated as wall latches 123; however, any suitable coupling mechanism may be used. Although, in the illustrated embodiment, the walls are coupled together, in other embodiments the walls may be integrally formed with one another.

In the illustrated embodiment, a first drain FD1 is formed in base 110; however, in other embodiments, first drain FD1 is formed in one of walls 120*a*-120*d* proximate the base. First drain FD1 is an opening through the container and is the structure through which contents of the liner bag exit the container. In the illustrated embodiment, drain FD1 is formed in the center of a side of the container; however drain FD1 may be located in a corner of a container. The drain is typically located proximate the bottom of the container to permit the contents of the container to be substantially completely emptied by gravity. For example, drain FD1 may be located within a lower quarter of the vertical extent of the container as measured from bottom B or drain FD1 may be located within a lower fifth of the vertical extent of the container as measured from bottom B or drain FD1 may be located within a lower tenth of the vertical extent of the container as measured from bottom B. Drain FD1 and door 125 may be formed in a same wall or different walls.

Figure 4A:
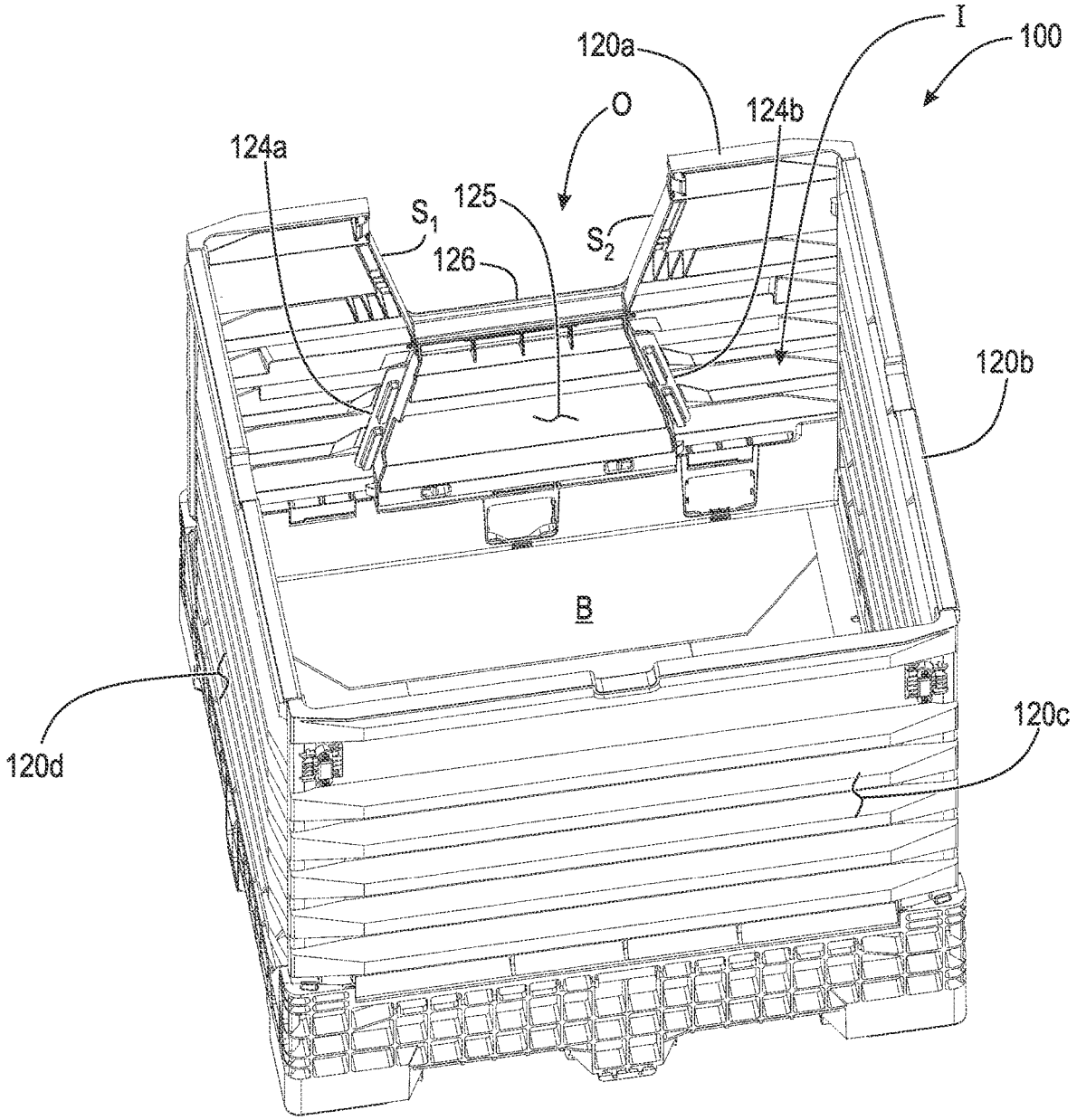
FIG. 4A is a perspective view of the container of FIG. 1, showing the bottom of the interior of the container, and the access door in an open position.
Figure 4B:
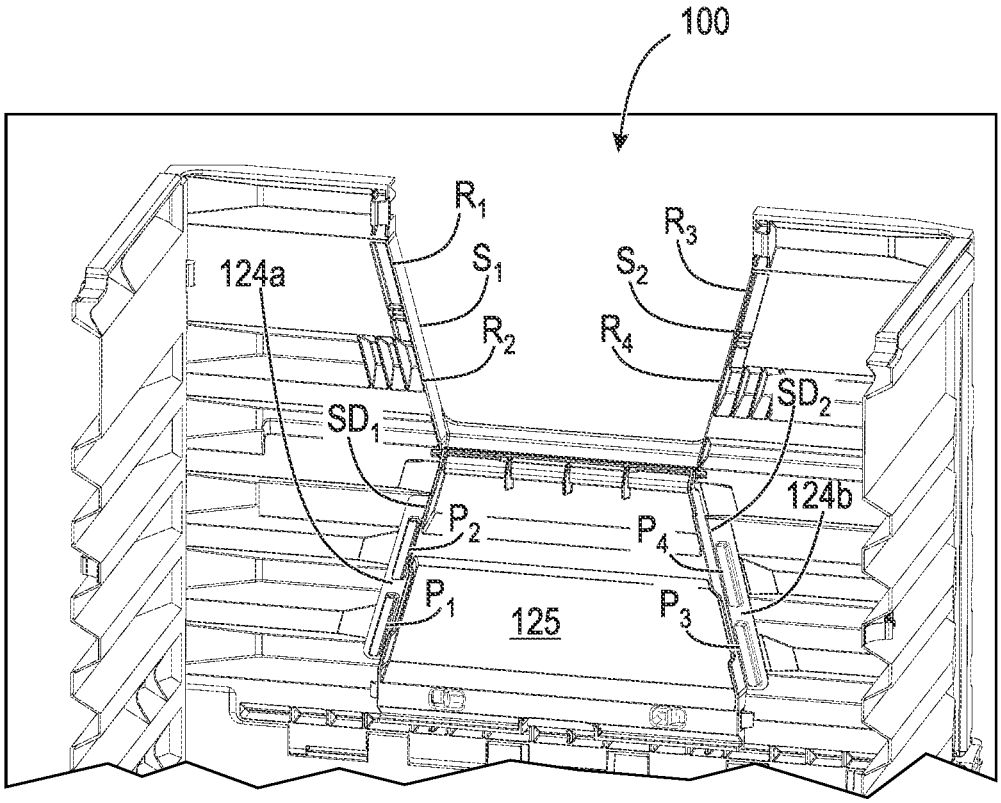
FIG. 4B is an expanded, partial, perspective view of the container of FIG. 1, with the access door in an open position, and showing further details of features to prevent the door from rotating beyond a wall of the container.

FIGS. 4A and 4B are perspective views of the container of FIG. 1, showing the interior space I of container 100 and access door 125 in an open position. Door 125 is coupled to one of the walls 120*a* by one or more hinges 126 and rotatable into the interior space I. Wall 120*a* has an opening O through which interior space I is accessible to a user U outside of the container. Door 125 is shaped to cover opening O. Opening O extends from a top of wall 120*a* to allow user U to extend his/her body into the container (shown in FIG. 4B). The one or more hinges are coupled to door 125 at the bottom of opening O and configured to allow the door to rotate into interior space I.

In the illustrated embodiment, lateral sides $S_1$ and $S_2$ of opening O are sloped such that the opening is larger at the top of the opening (i.e., at the top of wall 120*a*) than at the bottom of the opening. In some instances, such a configuration limits the impact on the shape of the opening during cooling of the plastic after molding of the walls, and allows the sides $S_1$ and $S_2$ of opening O to interface with and conform to lateral sides $SD_1$ and $SD_2$ of the door in a progressive manner as the door is closed, thereby facilitating closing of the door.

Door 125 and wall 120*a* are sized and shaped to prevent the door from rotating beyond wall 120*a* (i.e., a portion of the door interferes with a portion of wall 120*a*). In the embodiment shown in FIG. 4A, stop 124 (comprised of portions 124*a* and 124*b*) is formed on sides of door 125 to prevent door 125 from rotating beyond wall 120*a*. When door 125 is in a closed position, portion 124*a* of stop 124 extends laterally outward relative to opening O from the location of the interface of side $S_1$ and $SD_1$, at a given height from surface B; and when door 125 is in a closed position, portion 124*b* of stop 124 extends laterally outward relative to opening O from the location of interface of side $S_2$ and $SD_2$, at a given height from surface B. In the illustrated embodiment, stop 124 is shown as two portions 124*a* and 124*b* integrally formed with the remainder of door 125 (one on each lateral side of door 125) such that wall 120*a* is located in the path of door 125 as the door is rotated about hinge 126.

Although, in the illustrated embodiment, stop 124 is shown as disposed on door 125, it is to be understood that a stop may be alternatively formed on wall 120*a* at the perimeter of the opening. A stop on a wall would extend laterally inward relative to opening O from the locations of interface of side $S_1$, $S_2$ and/or S, $SD_2$, at a given height from surface B. Such a configuration may interfere with a user reading into the container. Additionally, a stop on a wall may comprise one or more portions (possibly extending along the bottom of opening O). A stop may or may not be integrally formed with wall 120*a* or door 125. Because the door and stop designs set forth above prevent rotation beyond the walls, the design is particularly effective at preventing inadvertent opening of the door during shipment, when the container is full. In some embodiments, a stop and door are provided with relief features to further secure door 125 against inadvertent opening. For example, in the illustrated embodiment, wall 120*a* has receptacles $R_1$-$R_4$ and door 125 has projections (also commonly referred to as bosses) $P_1$-$P_4$ that fit into the receptacles when the door is closed.

The wall, base and door designs set forth herein allow for use in a single-ply wall construction, and may be manufactured, for example using a compression molding technique, although other molding techniques may be used.

Figure 4C:
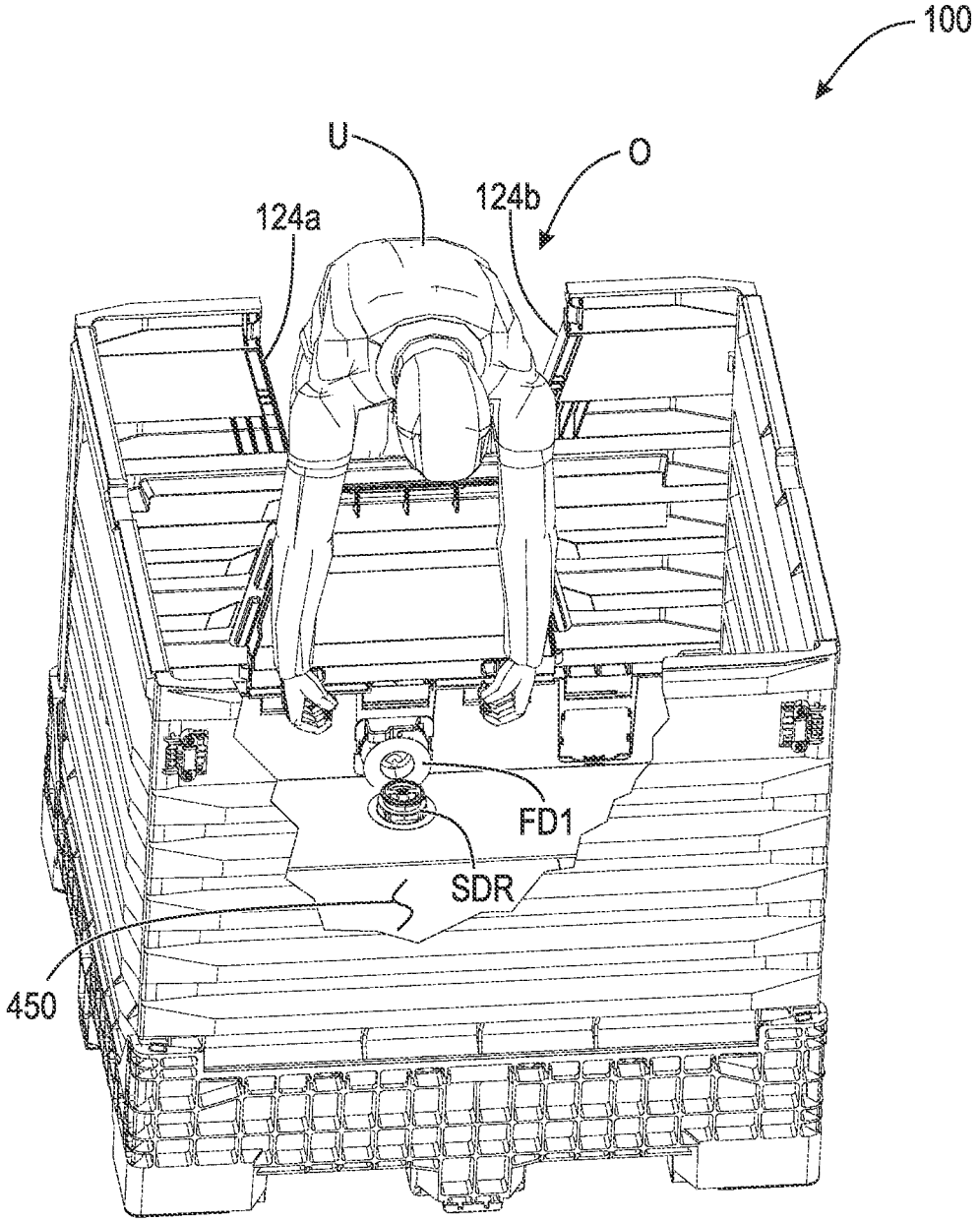
FIG. 4C is a perspective, partial view of the container of FIG. 1, showing the access door in an open position and a user installing a liner bag within the container.

FIG. 4C is a perspective, partial view of the container 100 of FIG. 1, showing access door 125 in an open position and a user U installing liner bag 450 (having a second drain SDR) within container 100. During the installation, the liner bag is introduced into the interior space. As illustrated, user U is able to extend his/her body into the container to install and align liner bag 450 within the container. Drains FD1 and SDR may be simple openings or may include a valve (not shown) to selectively control the flow of contents therethrough.

As shown in FIG. 4C, second drain SDR is sized and shaped to be operatively coupled at the first drain FD1 such that contents of the liner bag flow through drains FD1 and SDR and out of the container. For example, drains FD1 and SDR may be simply positioned such that second drain SDR extends through first drain FD1. In some embodiments, drains FD1 and SDR may be connected together. For example, drains FD1 and SDR may be threaded so that they can be rotatably connected together, although other types of connections (e.g., a snap connection) can also be used.

Figure 5A:
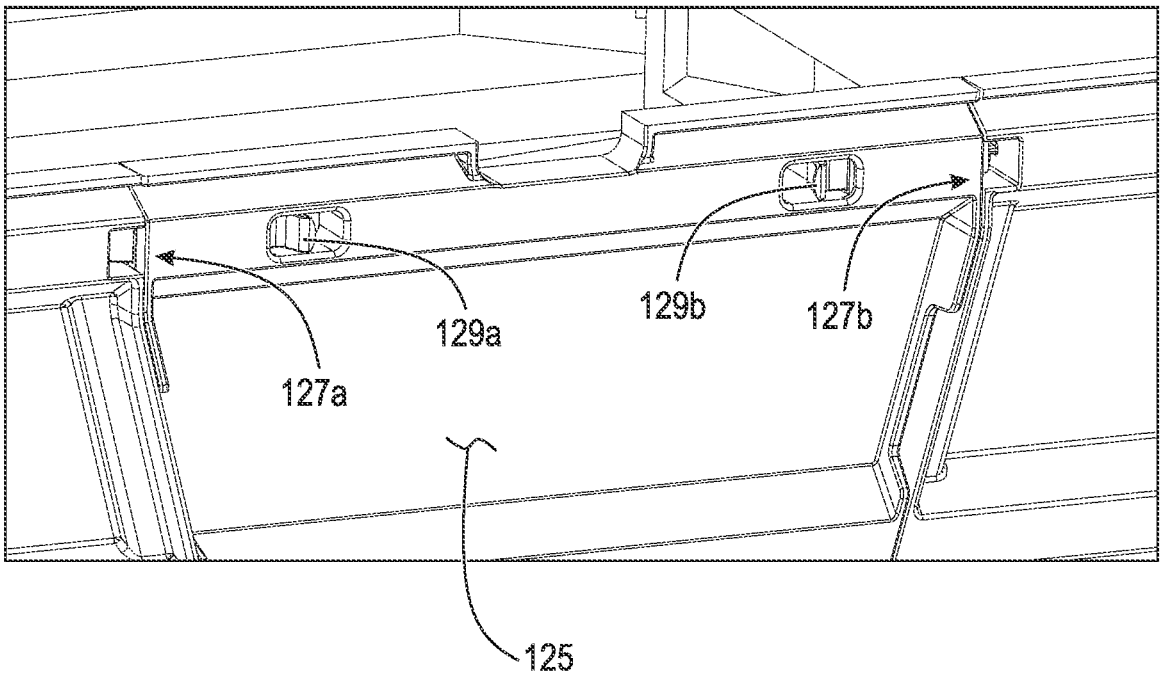
FIGS. 5A and 5B are partial views of the container of FIG. 1, showing one example of an access door latching mechanism in greater detail.
Figure 5B:
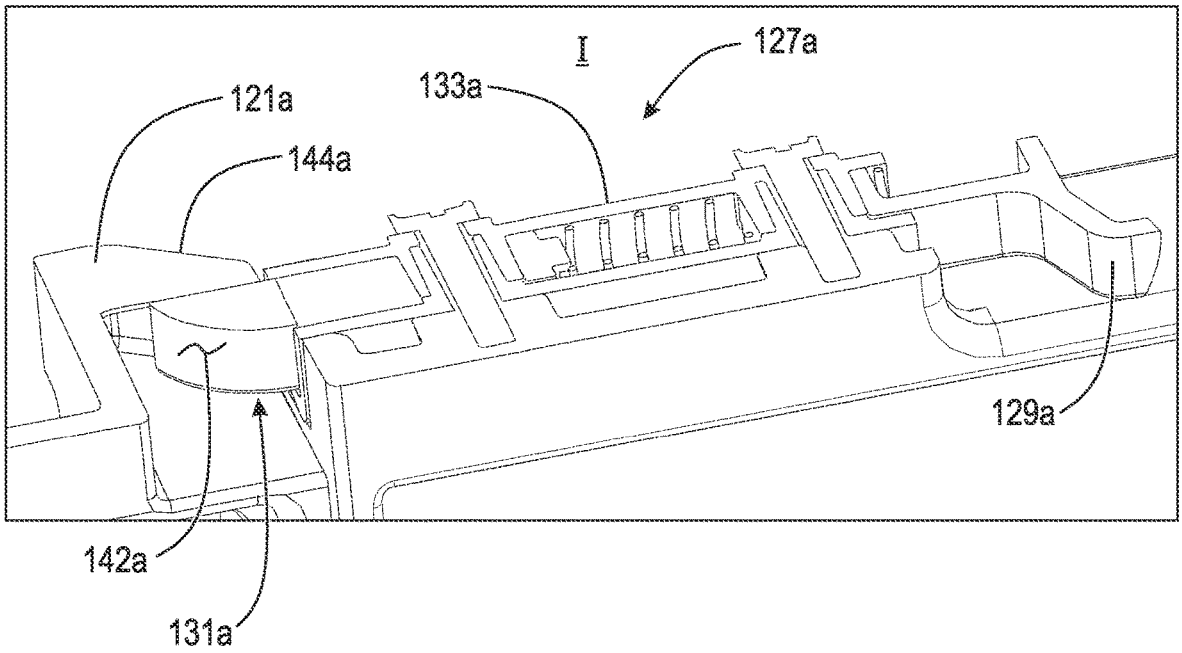

FIGS. 5A and 5B are partial views of the container 100 of FIG. 1, showing one example of an access door latching mechanism 127 (comprising portions 127*a* and 127*b*) in greater detail. Each portion 127*a* and 127*b* comprises a corresponding thumb press 129*a*, 129*b*. FIG. 5B shows portion 127*a* of the latching mechanism in greater detail. Only portion 127*a* is shown and discussed in detail; however, portion 127*b* is a mirror image of portion 127*a*.

Portion 127*a* includes a latch 131*a* that is biased by a spring 133*a* to a locked position. Thumb presses 129*a* and 129*b* are nested within door 125. Because stop 124 (shown in FIG. 4A) only allows door 125 to rotate into internal space I, when latch 131*a* is disposed on the outer side of catch 121*a* formed in wall 120*a* (as shown in FIG. 5B), door 125 is maintained in a closed position by catch 121*a* and stop 124. An additional feature of latching mechanism 127*a* results from latch having a sloped outer surface 142*a* and catch 121*a* having a sloped inner surface 144*a*, which allows latching mechanism 127*a* to operate automatically (i.e., without actuation of latch 131*a* using thumb press 129*a*) as door 125 is moved to the closed position. It will be appreciated that such a configuration allows latching mechanism 127 to operate as what is commonly known as a slam latch.

Although one example of a latching mechanism is shown in FIGS. 5A and 5B which has certain advantages, the basic purpose of the latching mechanism is maintain the door in an upright and secure position (e.g., locked position), and to allow selective opening of the door. It will be understood that any mechanism fulfilling this basic purpose may be used with aspects of the present invention. For example, the mechanism may be a slide bolt, a turn latch, a door knob or a hook-and-loop connector.

Figure 6:
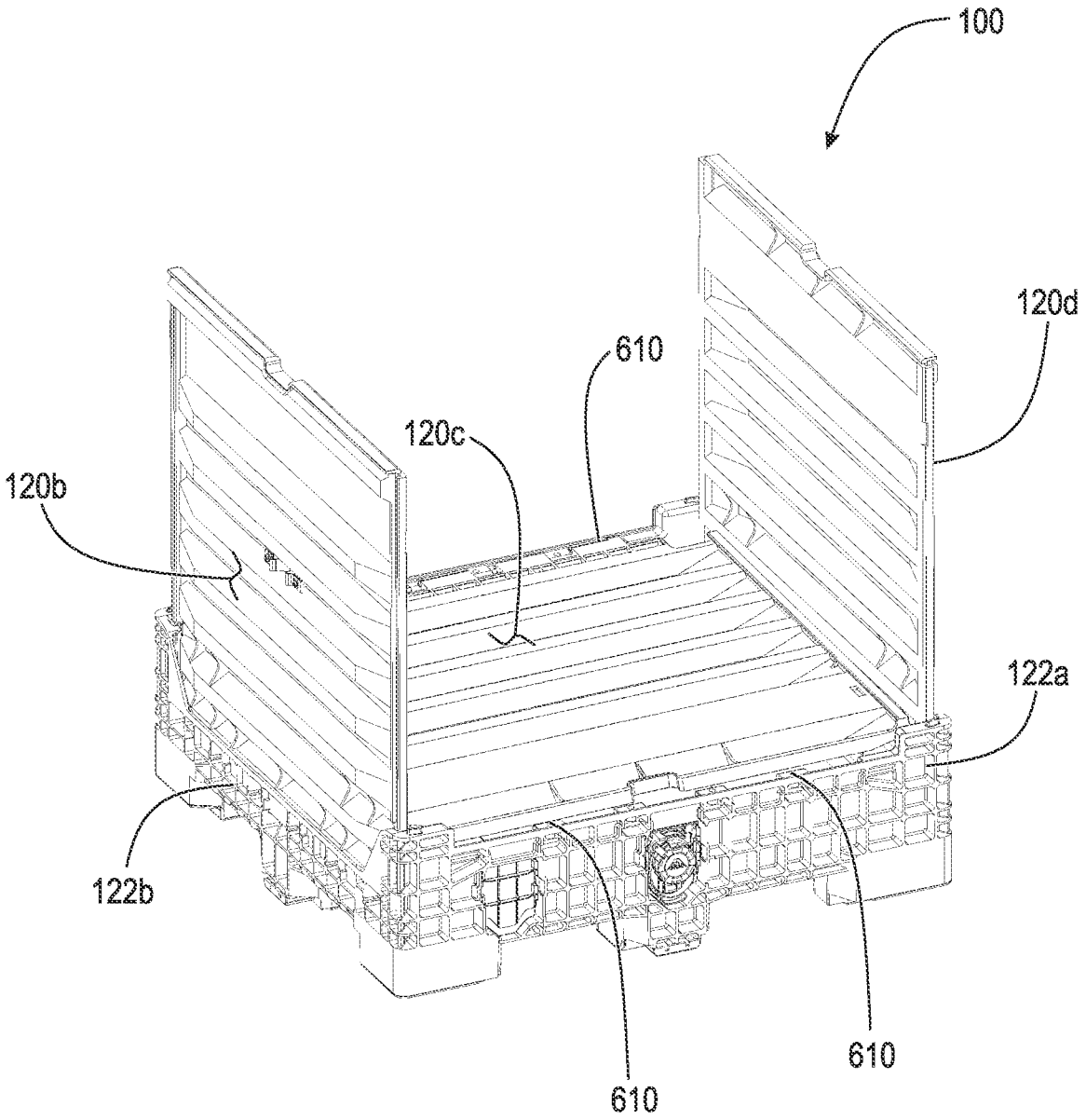
FIG. 6 is a perspective view of the container of FIG. 1 in a partially-collapsed state.

FIG. 6 is a perspective view of container 100 of FIG. 1 in a partially-collapsed state. In some embodiments, it is desirable that walls 120*a*-120*d* be able to attain collapsed positions by rotation about hinges (only representative hinges 610 are shown). In a collapsed position, a wall is substantially parallel to the bottom B (shown in FIG. 4A) of container 100. In FIGS. 6, walls 120*a* and 120*c* have been collapsed, while walls 120*b* and 120*d* remain upright.

Figure 7:
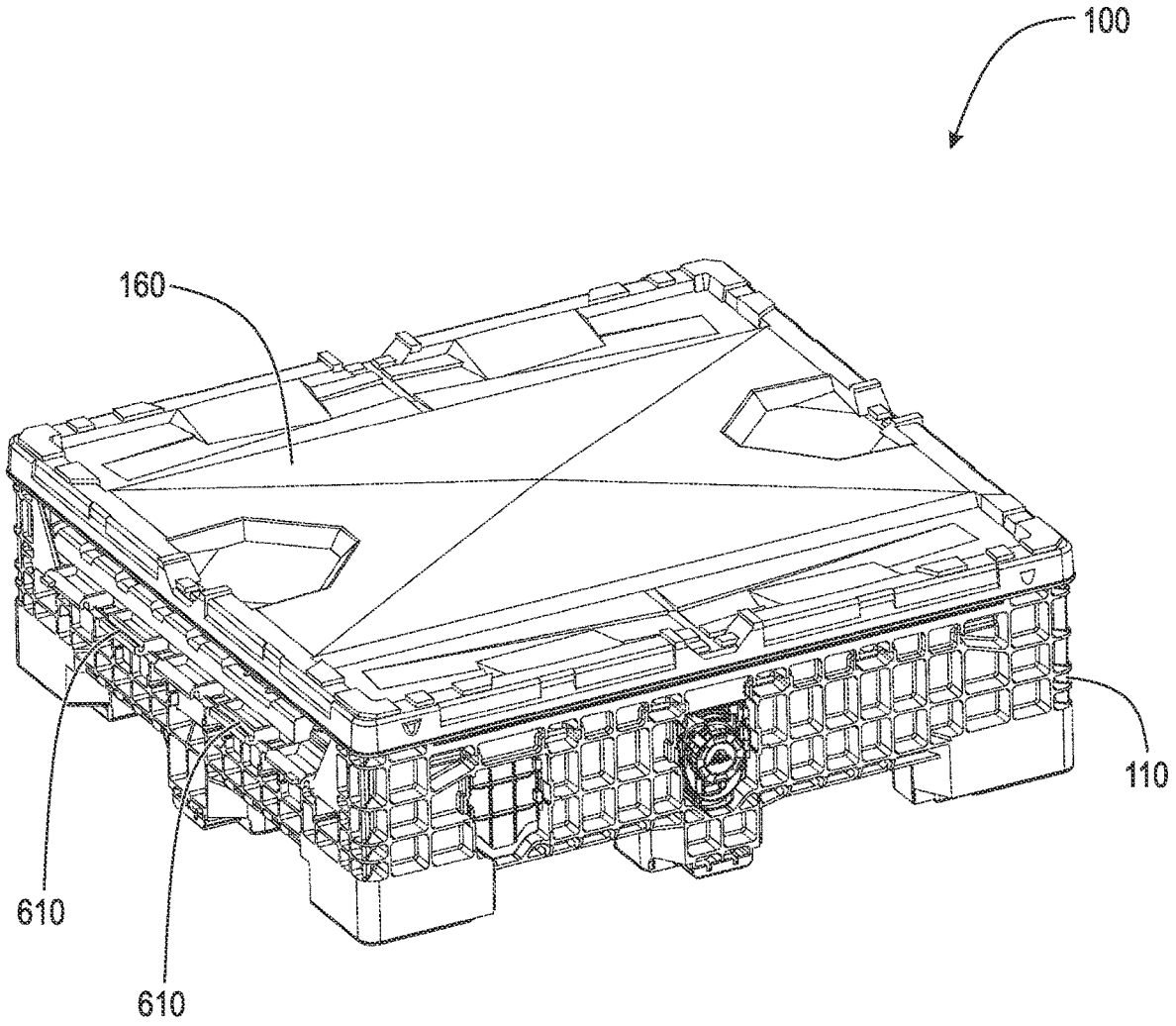
FIG. 7 is a perspective view of the container of FIG. 1 in a fully-collapsed state and with the cover disposed on top.

FIG. 7 is a perspective view of the container 100 of FIG. 1 in a fully-collapsed state. In FIG. 7, all walls 120*a*-120*d* are in a collapsed position, for example, to obtain a compacted configuration as may be used when the container is to be shipped when empty. In some embodiments, it is advantageous that the collapsed container be shipped with a cover 160 attached thereto. Cover 160 may be shaped to be snapped onto collapsed container (e.g., using molded features (not shown) of the cover and a wall) without the need of additional attachment components or the cover 160 may attached to the collapsed container walls using an attachment mechanism such as a band (not shown).

Although various embodiments have been depicted and described in detail herein, it will be apparent to those skilled in the relevant art that various modifications, additions, substitutions, and the like can be made without departing from the spirit of the invention and these are therefore considered to be within the scope of the invention as defined in the claims which follow.

What is claimed:

1. An intermediate bulk container system for shipping of goods, comprising:

a base and four walls extending from the base, the four walls together with the base defining an interior space;

a first drain formed in the base or in a first of the walls proximate the base;

a liner bag having a second drain operatively couplable to the first drain; and a door coupled to one of the walls by a door hinge and shaped to cover an opening in the one of the walls, the opening extending from a top of the one of the walls, the door hinge coupled to the door at the bottom of the opening and configured to allow the door to rotate into the interior space, and the door and the one of the walls sized and shaped to prevent the door from rotating beyond the one of the walls.

2. The system of claim 1, wherein lateral sides of the opening are sloped such that the opening is larger at the top of the opening than at the bottom of the opening.

3. The system of claim 1, wherein the walls of the container are of single-ply construction.

4. The system of claim 1, wherein each of the walls is coupled to the base by one or more wall hinges.

5. The system of claim 1, wherein the base comprises four partial walls each of the four walls coupled to a corresponding one of the partial walls.

6. The system of claim 1, wherein the first drain is located within a lower quarter of the vertical extent of the container system as measured from a bottom surface of the interior space.

7. The system of claim 1, wherein at least one of the first drain and second drain comprises a valve to selectively control flow of the goods therethrough.

8. The system of claim 1, wherein the first drain and the second drain are coupled together.

9. The system of claim 8, wherein the first drain and the second drain are connected together using at least one of a rotatable connection or a snap connection.

10. The system of claim 1, wherein the container system comprises a stop comprised of portions, each portion formed on a corresponding lateral side of the door to prevent the door from rotating beyond the one of the walls.

11. The system of claim 1, wherein the container system comprises a stop, the stop comprised of portions, each portions extending along a corresponding lateral side of the opening.

12. The system of claim 11, wherein the portions are integrally formed with the one of the walls.

13. The system of claim 1, wherein the first drain is formed in the first of the walls, and wherein the first of the walls and the one of the walls are a same wall.

14. A method of using an intermediate bulk container comprising a base and four walls extending from the base, the four walls together with the base defining an interior space, a first drain formed in the base or in a first of the walls proximate the base, and a door coupled to one of the walls by a hinge and shaped to cover an opening in the one of the walls, the opening extending from a top of the one of the walls, the hinge coupled to the door at the bottom of the opening configured to allow the door to rotate into the interior space and the door and the one of the walls sized and shaped to prevent the door from rotating beyond the one of the walls, the method comprising:

rotating the door into the interior space to expose the opening;

reaching through the opening to introduce a liner bag having a second drain into the interior space and to operatively couple the second drain at the first drain; and rotating the door to cover the opening.

15. The method of claim 14, wherein the step of rotating the door to cover the opening comprises rotating the door until contact occurs between a stop formed on the door and the one of the walls, or between the door and a stop extending along sides of the opening.

16. The method of claim 14, wherein the walls of the container are of single-ply construction.

17. The method of claim 14, wherein the first drain is located within a lower quarter of the vertical extent of the container as measured from a bottom surface of the interior space.

18. The method of claim 14, wherein operatively coupling comprises connecting the first drain and the second drain together using at least one of a rotatable connection or a snap connection.

19. The method of claim 14, wherein the first drain is formed in the first of the walls, and wherein the first of the walls and the one of the walls are a same wall.

20. An intermediate bulk container system for shipping of goods, comprising:

a base and four walls extending from the base, the four walls together with the base defining an interior space;

a first drain formed in the base or in a first of the walls proximate the base;

a liner bag having a second drain operatively couplable to the first drain; and a door coupled to one of the walls by a door hinge and shaped to cover an opening in the one of the walls, the opening extending from a top of the one of the walls, the door hinge coupled to the door at the bottom of the opening and configured to allow the door to rotate into the interior space, and the door and the one of the walls sized and shaped to prevent the door from rotating beyond the one of the walls, wherein the walls of the container system are of single-ply construction, wherein the first drain is located within a lower quarter of the vertical extent of the container system as measured from a bottom surface of the interior space.

* * * * *